US005829607A

United States Patent [19]

Ibrahim

[11] Patent Number: 5,829,607

[45] Date of Patent: Nov. 3, 1998

[54] DOUBLE ENDED BOTTLE

[76] Inventor: Moheb M. Ibrahim, 1300 Greenbriar Cir., Baltimore, Md. 21208

[21] Appl. No.: 805,068

[22] Filed: Feb. 25, 1997

Related U.S. Application Data

[63] Continuation-in-part of Ser. No. 577,060, Dec. 22, 1995, abandoned, which is a continuation of Ser. No. 258,191, Jun. 10, 1994, abandoned.

[51] Int. Cl.[6] ..... B65D 8/00; B65D 41/04

[52] U.S. Cl. ..... 215/44; 215/228; 215/329; 215/354; 220/916

[58] Field of Search ..... 220/288, 780, 220/796, 304, 916, 212; 215/44, 45, 43, 228, 6, 318, 320, 321, 329, 354, 341, 344, 352; 222/547, 215, 212, 209

[56] References Cited

U.S. PATENT DOCUMENTS

| | | | |
|---|---|---|---|
| 1,634,569 | 7/1927 | Bray . | |
| 2,611,499 | 9/1952 | Mayer . | |
| 2,917,198 | 12/1959 | Beall, Jr. | 215/329 |
| 2,962,187 | 11/1960 | Morris . | |
| 3,071,281 | 1/1963 | Sawai . | |
| 3,144,152 | 8/1964 | Kopp . | |
| 3,360,149 | 12/1967 | Roth | 215/45 X |
| 3,980,211 | 9/1976 | Owens | 222/547 X |
| 4,078,686 | 3/1978 | Karesh . | |
| 4,163,517 | 8/1979 | Kappler et al. . | |
| 4,669,621 | 6/1987 | Steigerwald et al. | 215/228 |
| 5,584,418 | 12/1996 | Schroeder et al. | 222/215 X |

FOREIGN PATENT DOCUMENTS

| | | | |
|---|---|---|---|
| 700614 | 12/1964 | Canada | 215/329 |
| 1485948 | 6/1967 | France | 215/44 |
| 3347591 | 7/1985 | Germany | 215/228 |
| 4006193 | 8/1991 | Germany | 215/329 |
| 2182648 | 5/1987 | United Kingdom . | |

*Primary Examiner*—Allan N. Shoap
*Assistant Examiner*—Nathan Newhouse
*Attorney, Agent, or Firm*—Terrance L. Siemens

[57] ABSTRACT

A double ended bottle having two narrow necks at opposed ends of the bottle. Sloped shoulders provide gentle transition between each neck and the full width of the body of the bottle. The bottle is internally open and unobstructed so that a common chamber extends from one opening to the other. Each neck has a threaded cap having two features for sealing against leaks past the cap. In one feature, an internal projection formed in each cap plugs the neck of the bottle. In an alternative embodiment, the neck has a separate adaptor or insert for reducing throat diameter. If this is provided, the projection is accordingly sized. Both the projection and the throat of the insert are beveled for centering the projection within the bore of the insert. The second sealing feature includes an external flange formed on each neck between the threads and the body of the bottle, and a corresponding groove formed in the cap. When each cap is fully threaded onto the bottle, the flange of the bottle seats within its respective groove. The caps are of diameters equal to that of the body, so that the bottle may be stood upright on a horizontal surface on either cap.

3 Claims, 2 Drawing Sheets

DOUBLE ENDED BOTTLE

REFERENCE TO RELATED APPLICATIONS

This application is a Continuation-In-Part of Ser. N. 08/577,060, filed Dec. 22, 1995, now abandoned, which is a Continuation of Ser. No. 08/258,191, filed Jun. 10, 1994, now abandoned.

BACKGROUND OF THE INVENTION

1. Field of the Invention

The present invention relates to bottles, and more particularly to a bottle having openings at opposed ends of the bottle, so that liquids may be dispensed selectively from both ends.

2. Description of the Prior Art

Bottles are employed to store and dispense many fluent materials. Some of these materials are highly viscous, and thus are slow to flow from the bottle. When a bottle filled with viscous contents nears depletion, the user is inconvenienced by being forced to wait while the material flows to and then through the neck of the bottle.

Another problem encountered in conventional bottles is that constituent components of a fluent material may separate from one another over time. When the bottle is poured, the heavier components may fail to be dispensed, only the upper or lighter fraction being present in a limited pour.

Both of these problems may be solved by a double ended bottle having a neck at opposed ends. The upper neck is employed until the amount desired has been used. From that time, each subsequent pour is conducted from whichever neck has become the lower neck when the bottle was replaced on a surface. Thus, a sluggish viscous material has less distance to flow when being dispensed, and heavier separated material will be present in the pour.

A carrying case having opposed removable caps is seen in U.S. Pat. No. 2,962,187, issued to Lowell H. Morris on Nov. 29, 1960. However, Morris provides a cylindrical body lacking inclined shoulders as seen in the present invention, and does not provide both threads for engaging a cap at each end as well as a flange and groove for preventing leakage, as seen in the present invention. The cap of Morris further lacks an internal projection plugging the neck of the container. The overall diameter of Morrists caps exceeds that of the body of the subject container, whereas in the present invention, these dimensions are equal.

A container seen in U.S. Pat. No. 3,071,281, issued to Shinichi Sawai on Jan. 1, 1963, illustrates a neck of diameter reduced from that of the overall body of the container and having an inclined shoulder. However, the neck is nearly the effective diameter of the body, which arrangement fails to afford control over pouring provided in the present invention. Sawai has internal baffles at both ends of the container which reduce effective volume of the chamber of the main body of the subject container. No comparable baffle or barrier is present in the present invention. Sawai's caps are conventional, and lack both an internal projection and cooperating flange formed in the container and cooperating groove formed in each cap, as seen in the present invention.

A U.K. Patent Application Number 2,182,648 A, published on May 20, 1987, illustrates an internal projection formed in a cap of a container. However, the subject container is not double ended, and the cap lacks a combination of threads and also a groove for receiving an outwardly projecting flange, this combination being found in the present invention. Also, the caps of the present invention are unitary, whereas the subject cap of the U.K. design has plural, mutually movable sections.

The prior art has failed to provide in a single bottle features which both enhance and control the pour in the manner of the present invention, and which may be stood upon either end on a horizontal environmental surface to enable fluent material to collect at a neck for rapid dispensing.

None of the above inventions and patents, taken either singly or in combination, is seen to describe the instant invention as claimed.

SUMMARY OF THE INVENTION

The present invention provides a double ended bottle adapted to stand on either end so that fluent materials contained in the bottle may flow towards and collect at a neck for rapid dispensing. The novel bottle is fabricated from a material enabling deformation by manual pressure, such as when squeezing the bottle, and is characterized by a relatively small neck for controlling the rate of pour. For many fluent materials stored in and dispensed from bottles, it is desired to deposit a small bead when pouring.

For example, a person dispensing a viscous concentrated shampoo may desire to observe and control the quantity being dispensed and deposited onto a finger of his or her hand. The two necks provided by the novel bottle are restricted in diameter to afford such control. The body of the bottle is sufficiently large as to be graspable by the hand, although the hand may not necessarily fully close over the body, while the neck and therefore the throat of the bottle is small enough to assure that a pour of limited diameter and magnitude be discharge when pouring. Given that bottles for storing many consumer products are of most convenient capacity and configuration when they are graspable in this manner, it follows that the neck should be restricted in diameter to half that of the body, and in some cases smaller in order to satisfactorily control the rate of pour.

The novel bottle is further characterized by having an inclined or sloping shoulder at each neck. The shoulders are arranged to promote downward flow into their respective necks without causing fluent material or matter settling out of suspension to be caught on a projection or horizontal surface.

The novel bottle has redundant features for defeating leakage past the threads engaging the caps. One feature is that each cap is provided with an internal projection which plugs the neck. In an alternative embodiment of the invention, the effective throat area of the neck is modified or reduced by an auxiliary removable insert. If this insert is provided, the internal projection of the cap is correspondingly reduced in diameter to assure a close fit with the actual or effective throat diameter.

A second sealing feature comprises an outwardly projecting flange formed on each neck of the bottle. Each cap has a corresponding groove in which the flange seats. The flange is located between the threads and the shoulder on each end of the bottle, so as not to interfere with threading of a cap on a neck.

Accordingly, it is a principal object of the invention to provide a double ended bottle for pouring fluent material selectively from both ends.

It is another object of the invention to configure the bottle to control the rate of pour and to expedite pouring of viscous materials when such materials are present only at one end of the bottle due to depletion.

It is a further object of the invention to configure the bottle to avoid entrapping fluent materials and separated components thereof within the bottle over time.

Still another object of the invention is to enable the bottle to be stood upright on a horizontal environmental surface selectively on both ends.

An additional object of the invention is to prevent leakage of contents of the bottle past threads engaging the cap.

It is again an object of the invention to provide a large chamber within the bottle extending from one port to the other port.

Yet another object of the invention is to provide a removable, auxiliary member for modifying throat area of a neck.

A still further object of the invention is that the bottle be manually deformable to manual pressure.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
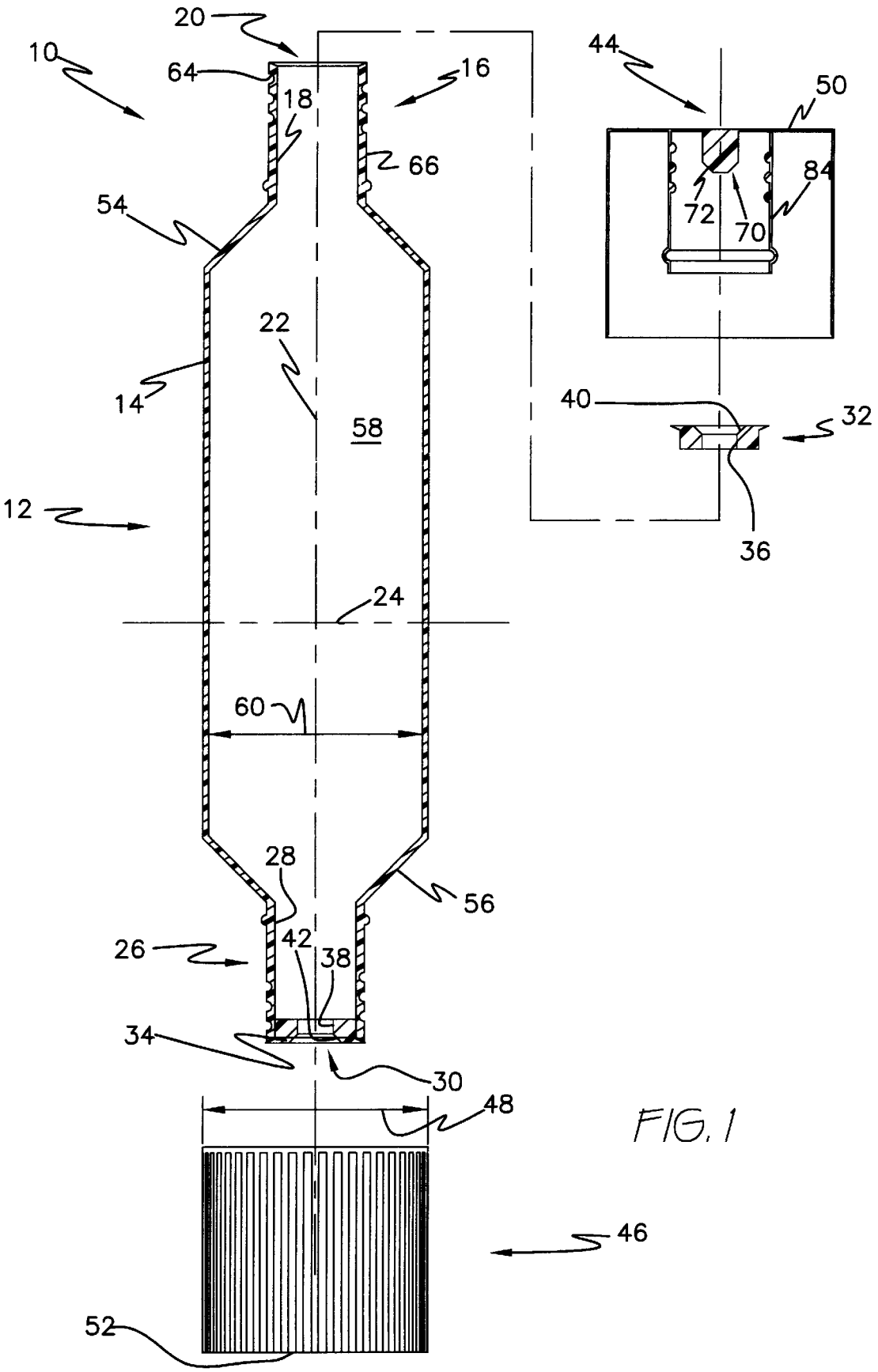
FIG. 1 is an exploded, side elevational, cross sectional view of the invention.

Turning now to FIG. 1 of the drawings, double ended bottle 10 is seen to comprise a body 12 having a central section wherein body 12 is of maximal diameter. Body 12 is formed by a lateral wall 14, an upper neck 16 having a first throat 18 and a first mouth 20 opening to the atmosphere. Neck 16 enables discharging of contents (not shown) contained within bottle 10.

Bottle 10 has a longitudinal axis or center line 22. A central plane 24 disposed perpendicularly to center line 22 divides bottle 10 into mirror image halves. For semantic clarity, components shown above central plane 24 in the depiction of FIG. 1 will be referred to as occupying the upper portion of bottle 10, while components shown below central plane 24 will be referred to as occupying the lower portion. Therefore, bottle 10 will be understood to comprise a lower neck 26 having a second throat 28 and a second mouth 30, these components being essentially mirror image counterparts of neck 16, first throat 18, and second mouth 30. The term mouth signifies the opening of its associated throat to the atmosphere for discharging contents of bottle 10.

Bottle 10 also has an upper insert 32 and a corresponding lower insert 34. These inserts 32, 34 are insertable into throats 18, 28, and serve the purpose of modifying or reducing the effective diameter, area, and configuration of throats 18 and 28. Inserts 32 and 34 have respective bores 36, 38. Bores 36, 38 are chamfered or beveled at 40 and 42. Bores 36, 38 reduce the rate of pour over that of throats 18 and 28 when less viscous materials are to be contained within bottle 10.

Each neck 16 or 26 is engaged and sealed by an associated cap 44 or 46. Caps 44, 46 are unitary and homogeneous, in that each comprises a single member having no relatively movable parts, and is formed from a single, homogeneous material. Each cap 44 or 46 has an external diameter, indicated at 48, which is equal to the external diameter of the body of bottle 10 at a wide point thereof. Each cap 44 or 46 has a flat end wall 50 or 52, respectively, arranged parallel to central plane 24.

The size and configuration, particularly surfaces 50, 52, of caps 44, 46 enable bottle 10 to stand upright on a horizontal environmental surface when stood selectively on either end of bottle 10 and when a cap 44 or 46 has been secured to bottle 10. Provision of two ends each capable of receiving a cap 44 or 46 assures that bottle 10 is reversible in that it may be stood upright on either end.

The body of bottle 10 has an upper shoulder 54 and a lower shoulder 56. Central plane 24 is disposed between upper shoulder 54 and lower shoulder 56. It is not actually critical that central plane 24 divide bottle 20 into equal upper and lower portions. Central plane 24 merely provides a convenient demarcation between upper and lower components of bottle 10.

Shoulders 54, 56 provide gentle transition between lateral wall 14 of the body of bottle 10 and necks 16, 26. Each shoulder 54 or 56 assumes a funnel shaped configuration in that at each point along center line 22, shoulder 54 or 56 has internal diameters and external diameters increasing in magnitude with increasing proximity of each selected point with respect to central plane 24.

The consequence of this construction is that whichever shoulder 54 or 56 is located below central plane 24 serves as a guide promoting downward migration of fluent material stored within bottle 10 to enter whichever neck 16 or 26 is disposed below central plane 24. No material or solids precipitating therefrom will tend to become caught on horizontal surfaces which might otherwise impede flow into neck 16 or 26.

Thus bottle 10 is seen to enclose a single chamber 58 extending and being continuously open from first mouth 20 to second mouth 30. The body of bottle 10 closes chamber 58 to the atmosphere at all points between first mouth 20 and second mouth 30. Chamber 58 has a chamber internal diameter 60, which is of magnitude at least twice that of the diameter of throat 20 and throat 30. This relationship enables volume of chamber 58 to be of convenient capacity, while assuring that throats 20, 30 will restrict flow when pouring to a rate convenient or suitable for controlling dispensing of contents of bottle 10 visually.

The body of bottle 10 is preferably fabricated from a material which is manually and resiliently deformable under manual pressure. This characteristic enables a user to eject fluent contents by squeezing bottle 10.

Figure 2:
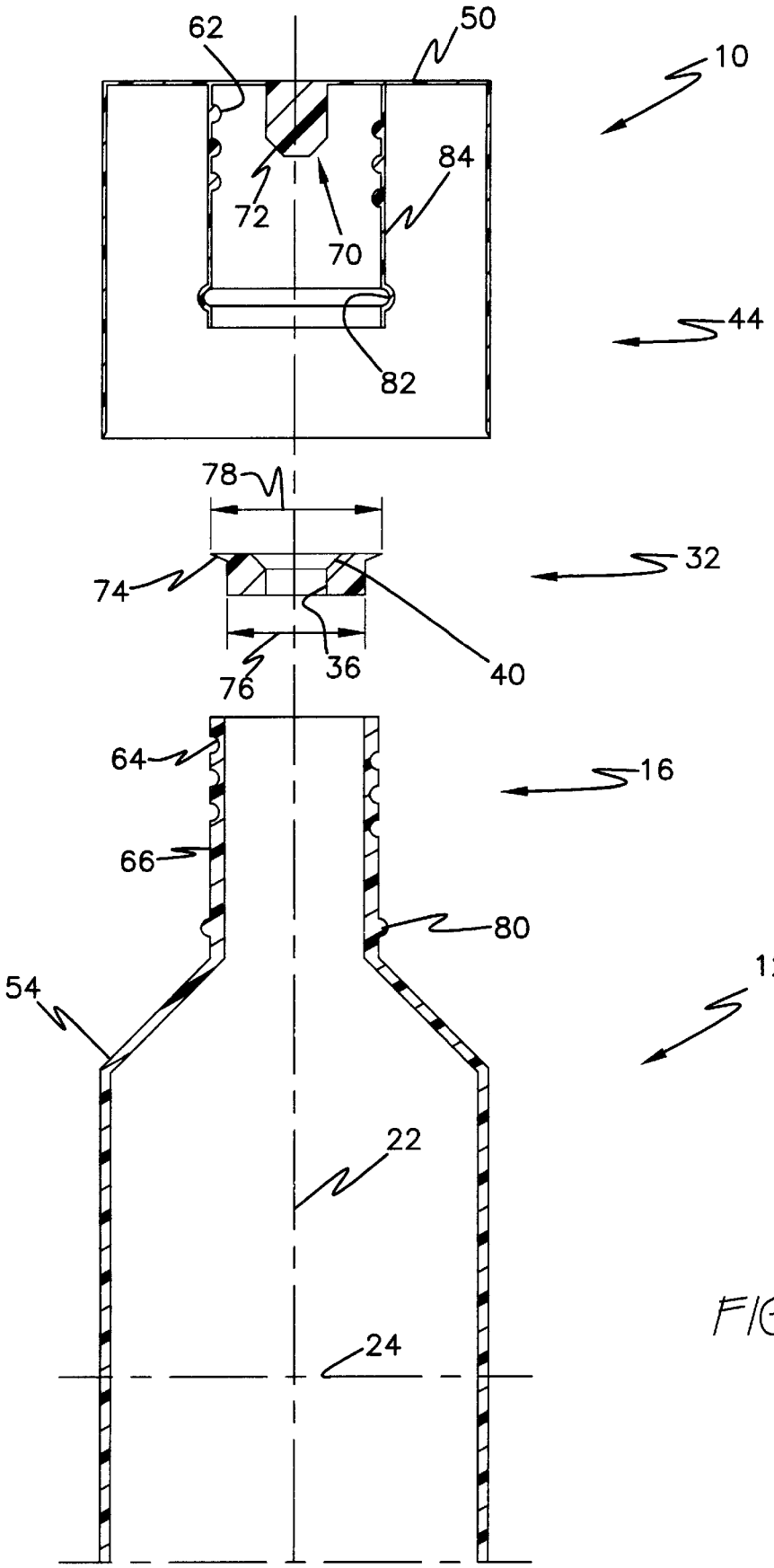
FIG. 2 is an exploded, side elevational, cross sectional detail view of the invention, drawn to enlarged scale.

FIG. 2 shows construction of cap 44 in greater detail. Of course, it will be understood that cap 46 and neck 26 have characteristics similar to those described with respect to cap 44. Cap 44 has threads 62 compatible with threads 64 formed on lateral surface 66 of neck 16. Threads 62 and 64 are merely representative of any suitable arrangement of structure for engaging and sealing of neck 16 by cap 44. Such engagement is accomplished by interlocking structure for slidably engaging and interfitting cap 44. Many different arrangements of pegs and grooves may be provided so that cap 44 may close neck 16. However, successful and convenient closure is best performed with helical threads 62 and 64.

If bottle 10 is inverted and stood upright when fluent materials are contained within, these materials could infiltrate and escape past threads 62, 64 over time. Bottle 10 is provided with two features for defeating such escape of contents. The first feature is a projection 70 beveled at 72. Projection 70 is disposed upon end wall 50 and projects into throat 18 when cap 44 is threaded to neck 16. Projection 70 is dimensioned and configured to plug throat 18 when cap 44 is fitted to neck 16.

It will be recalled that removable restricting insert 32 is optionally provided for adjusting effective area of throat 18. FIG. 2 shows that a lip 74 is formed at the top of insert 32, so that when insert 32 is partially inserted into throat 18, insert 32 will include a variable diameter including a relatively small diameter shown at 76, for fitting into throat 18, and a relatively great diameter, shown at 78, for causing interference opposing penetration of insert 32 into throat 18.

Penetration of projection 70 fully into bore 36 of insert 32 is aided by beveling at 72 to provide centering of projection 70 with respect to bore 36. Insert 32 has corresponding beveling at 40. If insert 32 is not provided, then throat 18 of neck 16 could optionally be modified to coinclude beveling corresponding to that of insert 32. Alternatively, projection 70 could be entirely frustoconical or otherwise tapered, rather than being essentially cylindrical with beveling 72. If this alternative is pursued, throat 18 would not need to have a beveled or tapered surface for centering of projection 70.

If insert 32 is provided, then bore 36, beveled at 40, will be dimensioned and configured to cooperate with projection 70 for sealing purposes. If insert 32 is not provided, then projection 70 is dimensioned and configured to fit closely to throat 18 of neck 16.

Leakage of contents from chamber 58 past threads 62 and 64 is sealed not only by engagement of projection 70 into either bore 36 of insert 32 or into throat 18 of neck 16. A second seal is provided by engagement of an outwardly projecting circular flange 80 formed on neck 16 within a groove 82 formed in cap 44. Flange 80 is disposed upon surface 66 of neck 16, and is located between threads 64 and shoulder 54. When cap 44 is fully threaded to neck 16, flange 80 seats within groove 82. Therefore, leakage which may have escaped past projection 70 will be sealed by flange 80 and groove 82.

Cap 44 is preferably provided with an internal wall 84 for bearing threads 62 and groove 82. An outer skirt 86 is provided to reinforce wall 50 against distortion of planar configuration and its angle parallel to central plane 24, and also for aesthetic reasons. Although the space existing between wall 84 and skirt 86 could be filled by constituent material of cap 44, it is preferred to conserve material and minimize weight by avoiding filled construction. The preferred construction also leads to the ability of cap 44 to deform slightly responsive to manual grasping when threading and unthreading cap 44 to neck 16. This deformation may possibly prevent breakage of cap 44 if constricting force nears elastic limits of the constituent material.

The present invention is susceptible to modifications and variations which may be introduced by those of skill in the art. For example, necks 16, 26 could be offset from longitudinal center line 22. If such an option were provided, then shoulders 54, 56 would not be radially symmetrical, but would still embody characteristics of funnels. It is also not important that bottle 10 be arranged to be of mirror image about central plane 24. For example, the upper neck could be relocated to align more closely with the right side of bottle 10, as illustrated in FIG. 1, while the lower neck could be relocated to align with the left side of bottle 10.

While bottle 10 has been described as being of mirror image construction with respect to central plane 24, other variations may be introduced. For example, only one neck 16 or 26 of bottle 10 need have any one or every recited feature.

It is to be understood that the present invention is not limited to the embodiments described above, but encompasses any and all embodiments within the scope of the following claims.

I claim:

1. A double ended bottle comprising:

a lateral wall;

an first neck having a first throat and a first mouth opening for discharging the contents of said bottle;

a second neck having a second throat and second mouth opening for discharging the contents of said bottle;

a first shoulder located between said lateral wall and said first neck;

a second shoulder located between said lateral wall and said second neck;

a single internal chamber extending between said first mouth opening and said second mouth opening;

a first cap having threaded engagement means for closing said first neck;

a second cap having threaded engagement means for closing said second neck;

said body having a longitudinal axis and a central plane located perpendicularly to said longitudinal axis, said central plane being disposed between said first shoulder and said second shoulder;

said both first and said second shoulders decrease in diameter from said central plane to said first and said second neck, respectively;

said single internal chamber having a chamber internal diameter, said first throat having a first throat diameter, said second throat having a second throat diameter, where said chamber internal diameter is at least twice the magnitude of both said first and said second throat diameter;

said first neck having a first neck outer surface including corresponding threaded engagement means for with said threaded engagement means of said first cap and said second neck having a second neck outer surface including corresponding threaded engagement means for with said threaded engagement means of said second cap;

said both first and second neck outer surfaces include a circular flange, said circular flange on said first neck located between said first shoulder and said corresponding threaded engagement means on said first neck, said circular flange on said second neck located between said second shoulder and said corresponding threaded engagement means on said second neck, and a corresponding groove is disposed on an interior of both said first and said second cap; whereby any leakage of contents from said single internal chamber is prevented by both said threaded engagement means and said circular flanges and said corresponding grooves.

2. The double ended bottle according to claim 1, wherein both said caps include an internal beveled projection dimensioned and configured to plug said first or said second throat when said cap is attached by said threaded engagement means.

3. The double ended bottle according to claim 1, wherein said bottle is fabricated from a material which is manually and resiliently deformable under manual pressure.

* * * * *

UNITED STATES PATENT AND TRADEMARK OFFICE

CERTIFICATE OF CORRECTION

PATENT NO. : 5,829,607

DATED : November 3, 1998

INVENTOR(S) : Moheb M. Ibrahim

It is certified that error appears in the above-identified patent and that said Letters Patent is hereby corrected as shown below:

Claim 1, Column 6, line49, delete "for".
Claim 1, Column 6. line 53, delete "for".

Signed and Sealed this

Eighth Day of February, 2000

*Attest:*

Q. TODD DICKINSON

*Attesting Officer*

*Commissioner of Patents and Trademarks*